US007941070B2

(12) United States Patent
Nakano

(10) Patent No.: US 7,941,070 B2
(45) Date of Patent: May 10, 2011

(54) ELECTROPHOTOGRAPHIC PHOTOSENSITIVE MEMBER AND IMAGE FORMING APPARATUS USING SAME

(75) Inventor: Kouichi Nakano, Hakusan (JP)

(73) Assignee: Kyocera Corporation, Kyoto (JP)

( * ) Notice: Subject to any disclaimer, the term of this patent is extended or adjusted under 35 U.S.C. 154(b) by 1087 days.

(21) Appl. No.: 11/677,507

(22) Filed: Feb. 21, 2007

(65) Prior Publication Data

US 2007/0201895 A1 Aug. 30, 2007

(30) Foreign Application Priority Data

Feb. 24, 2006 (JP) ..... 2006-049176
Mar. 28, 2006 (JP) ..... 2006-089519
Jun. 26, 2006 (JP) ..... 2006-175528
Jan. 31, 2007 (JP) ..... 2007-021415

(51) Int. Cl.
*G03G 15/00* (2006.01)

(52) U.S. Cl. ..... 399/96

(58) Field of Classification Search ..... 399/96, 399/159, 168, 170, 310, 311, 313
See application file for complete search history.

(56) References Cited

U.S. PATENT DOCUMENTS 3,874,942 A * 4/1975 Negishi et al. ..... 430/67
5,459,558 A 10/1995 Ishiyama
6,110,629 A 8/2000 Ehara et al.
6,122,467 A 9/2000 Ehara et al.
6,226,479 B1 5/2001 Karaki et al.
6,379,852 B2 4/2002 Tsuchida et al.
6,751,427 B2 * 6/2004 Sugiura ..... 399/100
6,944,413 B2 * 9/2005 Maeda ..... 399/92
7,151,904 B2 * 12/2006 Narita et al. ..... 399/159

FOREIGN PATENT DOCUMENTS

JP 53047838 U 4/1978
JP 60182452 A 9/1985
JP 63127267 A 5/1988
JP 04040480 A 2/1992
JP 04230776 A 8/1992
JP 04109776 A 9/1992
JP 05035053 A 2/1993
JP 05297681 A 11/1993
JP 06019246 A 1/1994

(Continued)

OTHER PUBLICATIONS

Japanese language office action and its English language translation for corresponding Japanese application 2007021415 lists the references above.

(Continued)

*Primary Examiner* — David P Porta
*Assistant Examiner* — Kiho Kim
(74) *Attorney, Agent, or Firm* — DLA Piper LLP (US)

(57) ABSTRACT

The present invention relates to an electrophotographic photosensitive member including a substantially cylindrical body and a photosensitive layer formed on the outer circumference of the body. The body has an outer diameter larger at a middle portion of a latent image forming area than at end portions of the latent image forming area in the axial direction. The electrophotographic photosensitive member may further include a heating member accommodated within the body and extending along the axial direction of the body, for heating the latent image forming area of the photosensitive layer.

9 Claims, 8 Drawing Sheets

FOREIGN PATENT DOCUMENTS

| | | | |
|---|---|---|---|
| JP | 08-160639 | | 6/1996 |
| JP | 08-160639 | A | 6/1996 |
| JP | 08160809 | A | 6/1996 |
| JP | 08-179531 | A | 7/1996 |
| JP | 10-073982 | | 3/1998 |
| JP | 10-073982 | A | 3/1998 |
| JP | 11202525 | A | 7/1999 |
| JP | 11-327183 | A | 11/1999 |
| JP | 2000098642 | A | 4/2000 |
| JP | 2004-310140 | A | 11/2004 |
| JP | 2005173283 | A | 6/2005 |
| JP | 2006039288 | A | 2/2006 |
| JP | 2006039323 | A | 2/2006 |

OTHER PUBLICATIONS

Japanese language office action and its English language translation for corresponding Japanese application 2007021416 lists the references above.

* cited by examiner

ELECTROPHOTOGRAPHIC PHOTOSENSITIVE MEMBER AND IMAGE FORMING APPARATUS USING SAME

CROSS-REFERENCE TO RELATED APPLICATIONS

The present application claims priority under 35 U.S.C. §119 to Japanese Patent Application No. 2006-049176, filed Feb. 24, 2006 No. 2006-089519, filed Mar. 28, 2006 No. 2006-175528, filed Jun. 26, 2006, No. 2007-21415, filed Jan. 31, 2007 entitled "ELECTROPHOTOGRAPHIC PHOTOSENSITIVE MEMBER, AND IMAGE FORMING APPARATUS USING SAME." The contents of this application are incorporated herein by reference in their entirety.

TECHNICAL FIELD

The present invention relates to an electrophotographic photosensitive member and an image forming apparatus provided with the same.

BACKGROUND ART

An image forming apparatus such as a copying machine and a printer utilizing electrophotographic method is provided with an electrophotographic photosensitive member. In such image forming apparatus, the electrophotographic photosensitive member is rotated by a power transmitter, and synchronously with the rotation, operations such as electrification, exposure, development, transfer, and cleaning are repeated, thereby forming an image on a recording medium.

Specifically, in the image forming apparatus, the electrophotographic photosensitive member is electrically charged at its surface and then rotated while being irradiated by laser light for exposure, according to an image pattern, so that an electrostatic latent image is formed on the surface of the electrophotographic photosensitive member. Next, the latent image is developed by attaching toner to the photosensitive member. The toner attached to the electrophotographic photosensitive member is transferred to a recording medium. After the transfer of toner to the recording medium, the electrophotographic photosensitive member is rotated while a cleaning blade is pressed onto the surface of electrophotographic photosensitive member, so that remaining toner is removed.

The electrophotographic photosensitive member includes a metal cylindrical body on which a photosensitive layer is formed. The photosensitive layer includes a photoconductive layer formed on the cylindrical body using inorganic material, and a surface layer formed using inorganic material to coat the photoconductive layer. In such electrophotographic photosensitive member, respective thicknesses of the photoconductive layer and the surface layer are normally set to be substantially constant in the axial direction of the entire cylindrical body. Here, "substantially constant" means that a ratio ($T_e$:$T_c$) of thickness ($T_c$) at the middle portion of the body to thickness ($T_e$) at one end or the other end of the body is not more than 1.001:1.

In the electrophotographic photosensitive member, a heating means may be provided for heating the photosensitive layer from inside. This is for preventing image deletion by reducing moisture at the photosensitive layer.

However, when heating the electrophotographic photosensitive member by the heating means from inside, heat is unlikely to be released at the middle portion in comparison with heat at the end portions in the axial direction of the body, and thus temperature at the middle portion tends to be relatively higher than temperature at the end portions. Such tendency becomes significant when heating by the heating means is performed for a long time (e.g. when many sheets of paper are printed continuously).

Meanwhile, in the electrophotographic photosensitive member, charge transfer tends to be activated as the surface temperature becomes higher. Thus, in the above-described electrophotographic photosensitive member, charging characteristic (property to carry electric charge) tends to become lower at the middle portion than at the end portions in the axial direction. As a result, in the above-described electrophotographic photosensitive member, variation in charging characteristic in the axial direction and thus variation in image density are likely to be generated.

DISCLOSURE OF THE INVENTION

An object of the present invention is to provide an electrophotographic photosensitive member and an image forming apparatus for preventing variation in image density.

According to a first aspect of the present invention, there is provided an electrophotographic photosensitive member comprising a substantially cylindrical body and a photosensitive layer formed on outer circumference of the body and having a latent image forming area.

The body has an outer diameter larger at a middle portion of the latent image forming area than at end portions of the latent image forming area in the axial direction.

According to a second aspect of the present invention, there is provided an image forming apparatus comprises an electrophotographic photosensitive member including a substantially cylindrical body having outer circumference on which a photosensitive layer with a latent image forming area is formed and a noncontact electrification means positioned substantially parallel to axial direction of the body.

A distance between surface of the electrophotographic photosensitive member and the electrification means is shorter at a middle portion of the latent image forming area than at end portions of the latent image forming area.

According to a third aspect of the present invention, there is provided an image forming apparatus comprising an electrophotographic photosensitive member including a substantially cylindrical body having outer circumference on which a photosensitive layer with a latent image forming area is formed and a non-contact electrification means positioned substantially parallel to axial direction of the body.

A length of a perpendicular line extending from a reference point on the latent image forming area to the electrification means is adjusted according to temperature at the reference point.

According to a fourth aspect of the present invention, there is provided an image forming apparatus comprising an electrophotographic photosensitive member including a substantially cylindrical body having outer circumference on which a photosensitive layer with a latent image forming area is formed and a non-contact electrification means positioned substantially parallel to axial direction of the body.

The image forming apparatus satisfies the following Formula 1.

$$0.6\ [\mu m/^\circ C.] \leqq D\ [\mu m]/T[^\circ C.] \leqq 10.0\ [\mu m/^\circ C.] \qquad \text{Formula 1}$$

In Formula 1, T indicates a difference between temperature of the electrophotographic photosensitive member at a first reference point on the latent image forming area and temperature of the electrophotographic photosensitive member at a second reference point on the latent image forming area, while D indicates a difference between a length of a first perpendicular line extending from the first reference point to the electrification means and a length of a second perpendicular line extending from the second reference point to the electrification means.

BEST MODE FOR CARRYING OUT THE INVENTION

An image forming apparatus and an electrophotographic photosensitive member according to the present invention are specifically described below with reference to the accompanying drawings.

Figure 1:
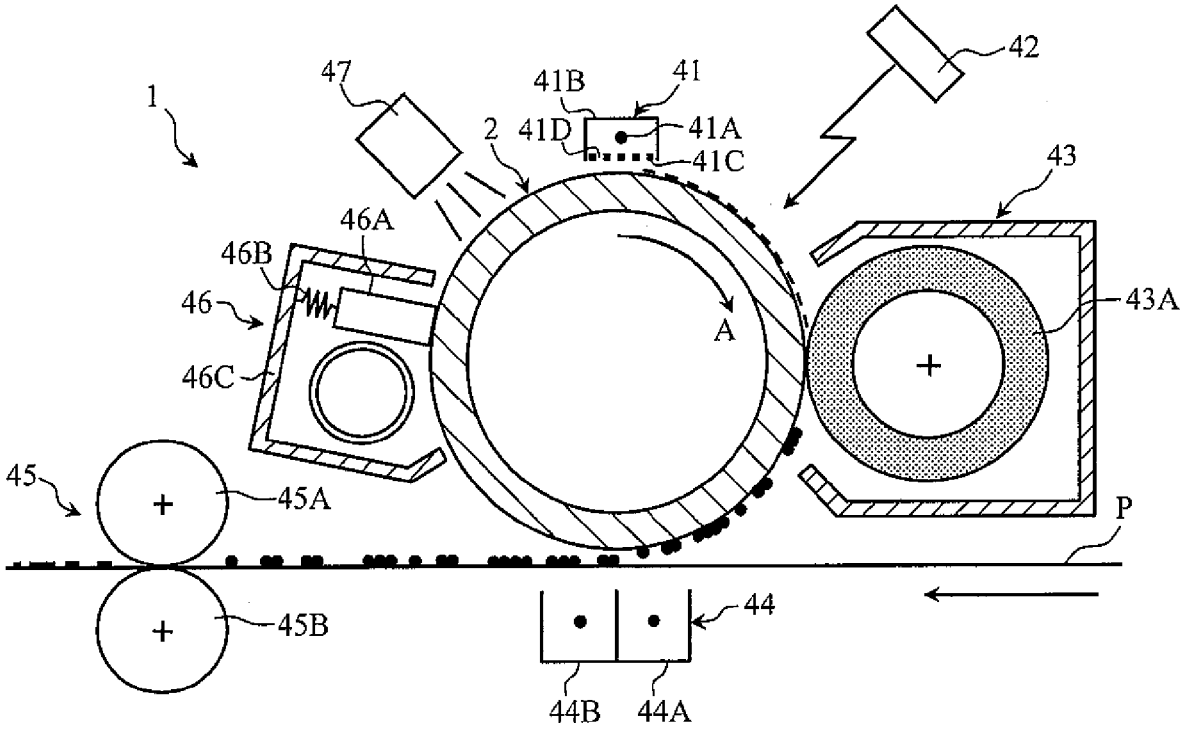
FIG. 1 is a schematic view illustrating an example of an image forming apparatus according to the present invention.
Figure 2:
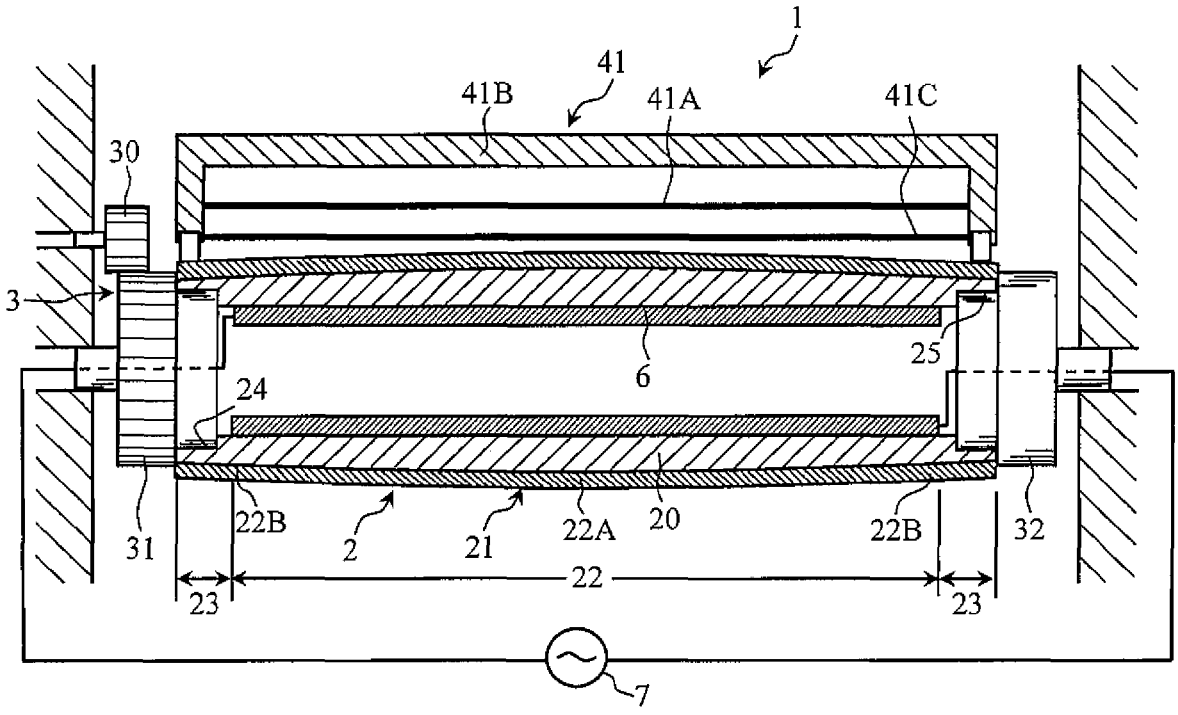
FIG. 2 is a sectional view of the principal portions illustrating the relationship between an electrophotographic photosensitive member and an electrification mechanism of the image forming apparatus shown in FIG. 1.

An image forming apparatus 1 shown in FIGS. 1 and 2 utilizes the Carlson method for image forming, and includes an electrophotographic photosensitive member 2, a rotation mechanism 3, an electrification mechanism 41, an exposure mechanism 42, a development mechanism 43, a transfer mechanism 44, a fixing mechanism 45, a cleaning mechanism 46, and a discharging mechanism 47.

Figure 3:
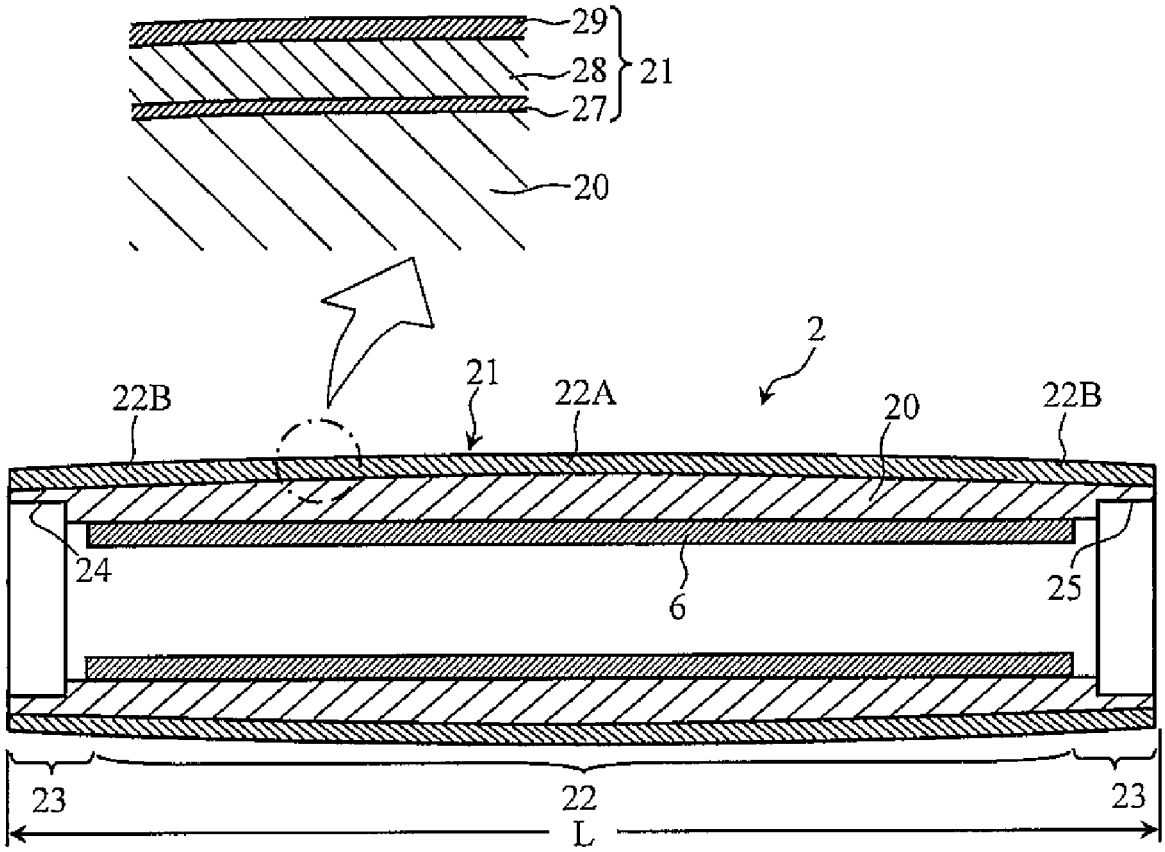
FIG. 3 is a sectional view and an enlarged view of the principal portions illustrating an example of the electrophotographic photosensitive member according to the present invention.

As shown in FIG. 2, an electrophotographic photosensitive member 2 forms an electrostatic latent image or a toner image according to an image signal, and can be rotated in the direction of an arrow A in FIG. 1, by a rotation mechanism 3. As shown in FIG. 3, the electrophotographic photosensitive member 2 includes a cylindrical body 20 having a surface on which a photosensitive layer 21 is formed.

The cylindrical body 20 forms the skeleton of the electrophotographic photosensitive member 2 and holds the electrostatic latent image on its outer circumference. The axis of the cylindrical body 20 has a length L slightly longer than the maximum length of a recording medium P such as a recording paper to be used. Specifically, the length L of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the end portions of the cylindrical body, next to the latent image forming area 22. The non-latent image forming areas 23 are areas of the photosensitive layer 21 (at the outside of the latent image forming area 22 in the axial direction) which are never to be used in forming a latent image of any size on the photosensitive layer 21.

In the cylindrical body 20, the outer diameter is larger at a middle portion 22A of the latent image forming area 22 than at end portions 22B of the latent image forming area 22 in the axial direction. In other words, in the cylindrical body 20, the outer diameter gradually becomes larger as proceeding from the end portions 22B toward the middle portion 22A of the latent image forming area 22. In the cylindrical body 20, as shown in FIG. 4A, the outer diameter may gradually become larger at a predetermined inclination as proceeding from the end portions 22B toward the middle portion 22A of the latent image forming area 22, or as shown in FIG. 4B, the outer diameter may become larger stepwise as proceeding from the end portions 22B toward the middle portion 22A of the latent image forming area 22.

Figure 4A:
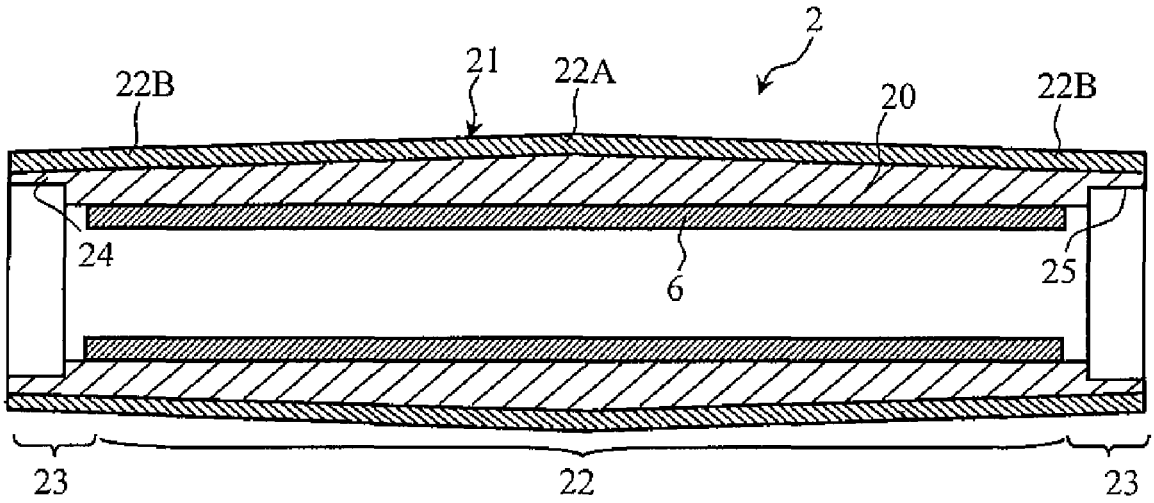
FIGS. 4A and 4B are sectional views illustrating other examples of the electrophotographic photosensitive member according to the present invention.
Figure 4B:
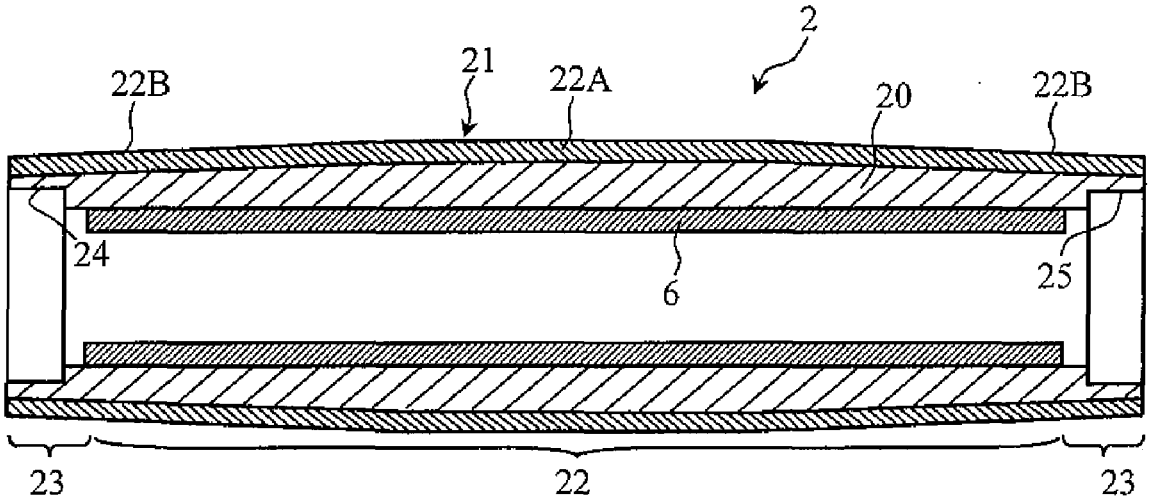

In the cylindrical body 20 shown in FIGS. 3, 4A, 4B, it is preferable that difference between the outer diameters at the end portions 22B of the latent image forming area 22 and at the middle portion 22A of the latent image forming area 22 is not less than 5 μm and not more than 150 μm. By setting the outer diameter of the cylindrical body 20 within the above range, even if a heater 6 to be described later heats the cylindrical body 20 (electrophotographic photosensitive member 2) from its inside when forming images, variation in image density due to variation in temperature of the cylindrical body 20 (electrophotographic photosensitive member 2) in the axial direction can be properly prevented.

Here, the outer diameter of the cylindrical body 20 is a diameter defined by a set of two points on the circumferential outer surface of the cylindrical body 20 opposed to each other. Ten sets of the two points on the circumference of the cylindrical body are measured and the measurement values are averaged to obtain the outer diameter. In measuring the outer diameter, a non-contact laser outer-diameter measuring device may be used, for example.

The cylindrical body 20 is provided with inside low portions 24, 25 having relatively large inner diameter. The inside low portion 24 is a portion to which a power transmitting flange 31, which is to be described later, of the rotation mechanism 3 is fitted (see FIG. 2), while the inside low portion 25 is a portion to which a bearing flange 32, which is to be described later, of the rotation mechanism 3 is fitted (see FIG. 2). The illustrated inside low portions 24, 25 are arranged within areas corresponding to the non-latent image forming areas 23, though may extend to an area corresponding to the latent image forming area 22. Further, the inside low portions 24, 25 may be omitted if not preventing the attachment of the flanges 31, 32.

Such cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fe, Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition.

Preferably, the cylindrical body 20 is made of a metal such as aluminum alloy or copper alloy. As aluminum alloy, Al—Mn (3000) alloy, Al—Mg (5000) alloy, and Al—Mg—Si (6000) alloy are more preferable. When making the cylindrical body 20 of aluminum alloy, casting, homogenization treatment, hot extrusion, and cold drawing are performed, and if necessary, softening is performed to form an aluminum alloy pipe. The aluminum pipe is cut into a predetermined length and the outer circumferential surface, the end surfaces, and the inside low surface are cut by e.g. working machine.

Further, an ultra-precise lathe with a diamond cutting tool is used for finishing, so that the cylindrical body 20 has a predetermined surface roughness and a predetermined outer diameter. Here, the cylindrical body 20 may be formed to have an outer diameter which is larger at the middle portion 22A of the latent image forming area 22 than at the end portions 22B of the latent image forming area 22 in the axial direction. The form of the outer circumferential surface of the cylindrical body 20 may be easily obtained, when cutting the outer circumference in the body manufacturing process, by using a NC lathe for controlling the movement of the cutting tool by a NC program. Further, grinding may be performed by a grinding machine.

Thereafter, the cylindrical body 20 is cleaned for degreasing cutting oil used in cutting (grinding) and for removing dirt such as swarf. As a cleaning liquid for cleaning, water-based detergent, petroleum detergent, alcohol detergent, or chlorine solvent may be used. Preferably, a cleaning machine having at least two cleaning tubs and one rinsing tub or raising tub is used, and ultrasonic waves are applied to cleaning liquid in the cleaning tubs. In place of applying ultrasonic waves, showering or bubbling by inert gas may be performed. It is preferable that, in the cleaning machine, a cleaning liquid is supplied to one of the cleaning tubs close to a drain outlet with a high cleaning property and overflows to the other cleaning tub close to an inlet.

The cylindrical body 20 accommodates a heater 6 for heating the photosensitive layer 21. The heater 6 prevents image deletion by reducing moisture at the photosensitive layer 21.

Figure 5:
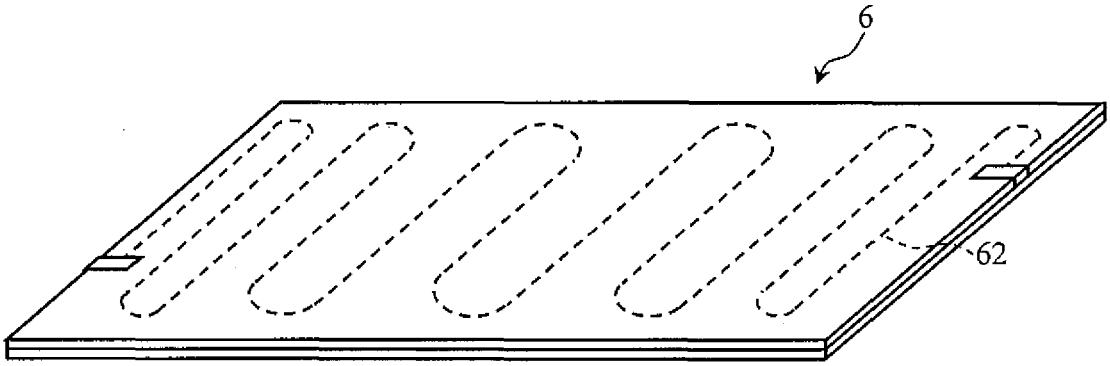
FIG. 5 is an overall perspective view illustrating a heater provided at the electrophotographic photosensitive member shown in FIG. 3 or 4.
Figure 6:
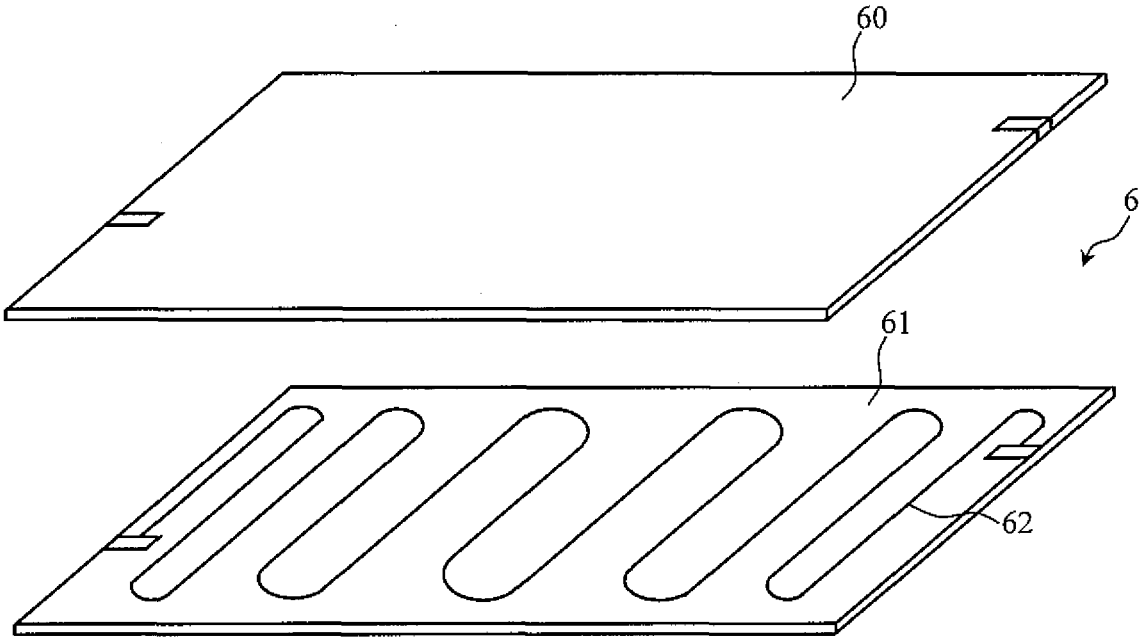
FIG. 6 is an exploded perspective view illustrating the heater shown in FIG. 5.

As shown in FIGS. 5 and 6, the heater 6 is formed into a sheet as a whole, and is rolled into a tube to be accommodated within the cylindrical body 20. The heater 6 includes a pair of insulating sheets 60, 61 sandwiching a resistor 62 therebetween.

The insulating sheets 60, 61 are made of an insulating resin such as silicon resin, PET (polyethylene terephthalate) and acrylate resin, and has a thickness not less than 0.5 mm and not more than 3.5 mm.

The resistor 62 is formed on the insulating sheets 61 by patterning. In the illustrated example, the resistor 62 is formed in a wavy line in an arrangement thinner at the middle portion than at the end portions. Thus, in the resistor 62 (the heater 6), heat-generating temperature at the middle portion is lower than at the end portions.

A material for making the resistor 62 is not limited at least it generates heat by electrical conduction, and includes a metal such as nickel chrome alloy and copper, and a heat-generating material such as carbon system or metal oxide system, for example. The resistor 62 may be formed by arranging a wire rod or by coating a film on the insulating sheet 61 using the above-described materials.

Such heater 6 is accommodated within the cylindrical body 20 in contact with the inner circumferential surface utilizing resilience of the insulating sheets 60, 61. Thus, the heater 6 can be accommodated within the cylindrical body 20, without using a screw or an adhesive.

Of course, the structure of the heater 6 is not limited to the one shown in FIGS. 5 and 6. For example, in the heater 6, the resistor 62 is not necessarily formed in an arrangement thinner at the middle portion but may be formed in a uniform arrangement. Further, the resistor 62 is not necessarily formed in a wavy line or into a sheet, but may be formed into a column or other forms.

As shown in FIG. 2, the heater 6 is connected to a power source 7 of the image forming apparatus 1, so that the resistor 62 generates heat by electrical force supplied from the power source 7 and that the photosensitive layer 21 of the electrophotographic photosensitive layer 2 is heated up to not less than 30° C. and not more than 60° C. In this way, moisture at the photosensitive layer 21 is reduced, and thus image deletion is prevented.

As shown in FIG. 3, the photosensitive layer 21 is formed by lamination of an anti-charge injection layer 27, the photoconductive layer 28 and the surface layer 29.

The anti-charge injection layer 27 serves to prevent injection of electrons and electron holes from the cylindrical body 20 into the photoconductive layer 28, and various types of anti-charge injection layer 27 may be used depending on the material of the photoconductive layer 28. The anti-charge injection layer 27 may be made of an inorganic material, for example, and if using a-Si material for the photoconductive layer 28, the anti-charge injection layer 27 may also be made of an inorganic material such as a-Si material. In this way, electrophotographic photosensitive property with enhanced adhesiveness between the cylindrical body 20 and the photoconductive layer 28 can be obtained.

In forming the anti-charge injection layer 27 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 28 of a-Si material so as to determine the conductivity type. Further, a large amount of boron (B), nitrogen (N), or oxygen (O) may be also contained so as to have high resistivity.

Note that the anti-charge injection layer 27 is optional and is not always necessary. The anti-charge injection layer 27 may be replaced with a long-wavelength light absorbing layer. The long-wavelength light absorbing layer prevents a long-wavelength light (light of a wavelength of not less than 0.8 μm) entering on exposure from reflecting on the surface of the cylindrical body 20, and thus prevents a fringe pattern generated at a formed image.

In the photoconductive layer 28, electrons are excited by a laser irradiation from the exposure mechanism 42, and a carrier of free electrons or electron holes is generated. The thickness of the photoconductive layer 28 may be determined according to a photoconductive material and a desired electrophotographic property.

The photoconductive layer 28 is formed of a-Si material, amorphous selenium material such as a-Se, Se—Te, and As2Se3, or chemical compound of twelfth group element and sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 28 is made of a-Si, or an a-Si alloy material of a-Si and an element such as C, N, and O, it is able to have high luminous sensitivity, high-speed responsiveness, stable repeatability, high heat resistance, high endurance, and so on, thereby reliably obtaining enhanced electrophotographic property. Further, in addition to the above condition, by forming the surface layer 29 using a-SiC:H, conformity of the photoconductive layer with the surface layer 29 is enhanced. The photoconductive layer 28 may be also formed by changing the above-described inorganic material into particles, and by dispersing the particles in a resin, or may be formed as an OPC photoconductive layer.

In forming the photoconductive layer 28 using an inorganic material as a whole, it can be formed by conventional film formation methods such as glow discharge decomposition method, various sputtering methods, various vapor deposition methods, ECR method, photo-induced CVD method, catalyst CVD method, and reactive vapor deposition method, for example. In film forming of the photoconductive layer 28, hydrogen (H) or a halogen element (F, Cl) may be contained in the film by not less than one atom % and not more than 40 atom % for dangling-bond termination. Further, in forming the photoconductive layer 28, for obtaining a desired property such as electrical property including e.g. dark conductivity and photoconductivity as well as optical bandgap in respective layers, thirteenth group element or fifteenth group element, or an adjusted amount of element such as C, N, and O may be contained.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 28 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that concentration gradient is generated in the thickness direction of the layers, if the average content of the elements in the layers is within the above-described range.

In forming the photoconductive layer 28 using a-Si material, μc-Si (microcrystal silicon) may be contained, which enhances dark conductivity and photoconductivity, and thus advantageously increases design freedom of the photoconductive layer 3. Such μc-Si can be formed by utilizing a method similar to the above-described method, and by changing the film forming condition. For example, when utilizing glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when μc-Si is contained.

The surface layer 29 shown in FIG. 3 for protecting the photoconductive layer 28 from friction and wear is laminated on the surface of the photoconductive layer 28. The surface layer 29 is formed of an inorganic material represented by a-Si material such as a-SiC, and has a thickness of not less than 0.2 μm and not more than 1.5 μm. By making the surface layer 29 to have a thickness of not less than 0.2 μm, flaw in image and variation in density due to wear can be adequately prevented, and by making the surface layer 26 to have a thickness of not more than 1.5 μm, initial characterization (such as defective image due to residual potential) can be adequately improved. Preferably, the thickness of the surface layer 29 may be not less than 0.5 μm and not more than 1.0 μm.

Such surface layer 29 is preferably formed of a-SiC:H in which a-SiC contains hydrogen. Proportion of elements in a-SiC:H can be expressed in a composition formula a-$Si_{1-x}C_x$:H, in which the value of X is not less than 0.55 and less than 0.93, for example. By setting the value X to not less than 0.55, a proper hardness for the surface layer 29 can be obtained, and endurance of the surface layer 29 and thus of the electrophotographic photosensitive member 2 can be reliably maintained. By setting the value X to less than 0.93, a proper hardness for the surface layer 29 can be also obtained. Preferably, the value X is set to not less than 0.6 and not more than 0.7. In forming the surface layer 29 using a-SiC:H, H content may be set to about not less than one atom % and not more than 70 atom %. When the H content is set within the above range, Si—H binding is lower than Si—C binding, electrical charge trap generated by light irradiation on the surface of the surface layer 26 can be controlled, thereby suitably preventing residual potential. According to the knowledge of the inventors, by setting the H content to not more than about 45 atom %, more favorable result can be obtained.

Figure 7:
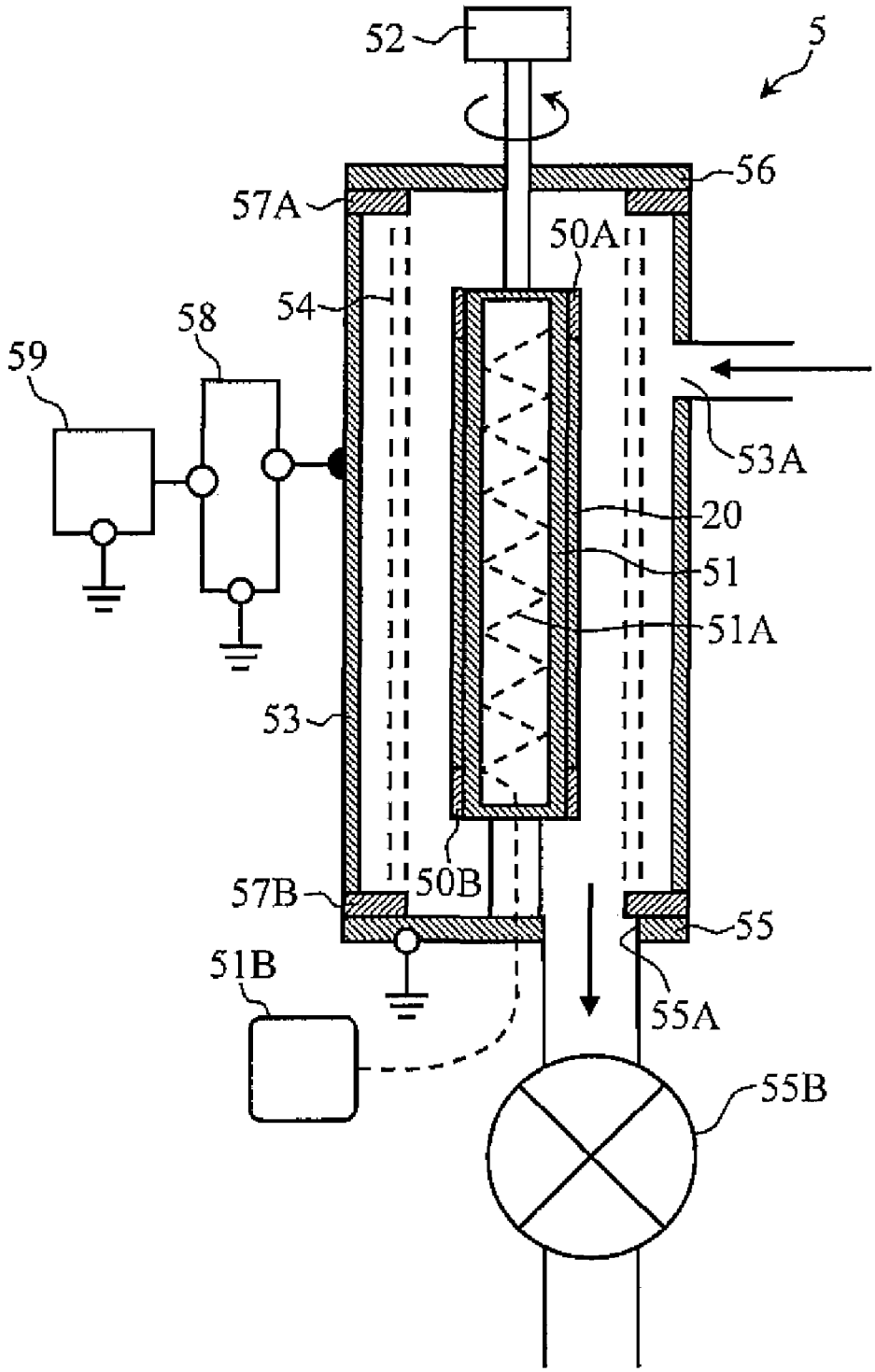
FIG. 7 is a sectional view illustrating a CVD apparatus for forming a photosensitive layer of the electrophotographic photosensitive member shown in FIG. 3 or 4.

Such photosensitive layer 21 (including the anti-charge injection layer 27, the photoconductive layer 28, and the surface layer 29) can be formed utilizing a CVD apparatus 5 shown in FIG. 7. The illustrated CVD apparatus 5 includes a body holder 51 to which the cylindrical body 20 is attached. The body holder 51 incorporates a heater 51A. The heater 51A is provided with a temperature controller 51B for controlling heating temperature. The body holder 51 is rotated by a motor 52.

The CVD apparatus 5 also includes various components, such as a chamber 53, a discharging electrode plate 54, a reactor base 55, a reactor lid 56, and insulating rings 57A, 57B, surrounding the body holder 51 (the cylindrical body 20) for providing a reactor. The chamber 53 is provided with a gas inlet port 53A for introducing reaction gas, while the reactor base 55 is provided with an exhaust port 55A and a discharge valve 55B connected thereto, for pressure control in the CVD apparatus 5. The CVD apparatus 5 further includes a high-frequency power source 58 for performing electrical discharge between the cylindrical body 20 and the discharging electrode plate 54. The high-frequency power source 58 is connected to a matching box 59 for stabilizing glow discharge.

When forming the photosensitive layer 21 on the cylindrical body 20 using the CVD apparatus 5, first, the cylindrical body 20 after cleaning is inserted into the body holder 51 together with positioning rings 50A, 50B, so that the cylindrical body 20 is positioned within the reactor. Meanwhile, air in the reactor is discharged through the exhaust port 55A to depressurize the reactor.

Next, the cylindrical body 20 and the body holder 51 are rotated by the motor 52, while temperature of the cylindrical body 20 is heated up by the heater 51A and the temperature controller 51B. The heating of the cylindrical body 20 and the depressurizing of the reactor may be performed at the same time, or may be performed in reverse order.

Thereafter, by adjusting the amount of supply gas flowing in through the gas inlet port 53A and exhaust gas flowing out through the exhaust port 55A to control pressure in the reactor.

The supply gas is a mixture of material gas and diluent gas. As the material gas, e.g. $SiH_4$, $B_2H_6$, or NO may be used when forming the anti-charge injection layer 27, e.g. $SiH_4$ or $B_2H_6$ may be used when forming the photoconductive layer 28, and e.g. $SiH_4$ or $CH_4$ may be used when forming the surface layer 29. Gas of the same quality and system as the above-described gases may be used as the material gas. For example, $Si_2H_6$, $B_4H_{10}$, $N_2O$, and acetylene gas or butane may be used in place of $SiH_4$, $B_2H_6$, NO, and $CH_4$, respectively. As the diluent gas, hydrogen gas, helium gas, or argon gas may be used, for example.

Meanwhile, high frequency power is applied to the chamber 53 and the discharging electrode plate 54 by the high frequency power source 58 via the matching box 59, so that glow discharge is performed between the cylindrical body 20 and the discharging electrode plate 54. In this way, the mixed material gas is decomposed and deposited on the cylindrical body 20, thereby forming the anti-charge injection layer 27, the photoconductive layer 28, and the surface layer 29. Here, as the cylindrical body 20 is rotated by the motor 52, film thickness and photoconductive characteristic of the photosensitive layer 21 (including the anti-charge injection layer 27, the photoconductive layer 28, and the surface layer 29) are made to be constant in the circumferential direction.

As shown in FIG. 2, the rotation mechanism 3 rotates the electrophotographic photosensitive member 2. The rotation mechanism 3 rotates the electrophotographic photosensitive member 2 at a constant circumferential velocity of 320 mm/sec. The rotation mechanism 3 includes a drive gear 30, the power transmitting flange 31, and the bearing flange 32.

The drive gear 30 transmits the rotation power of a motor (not shown) to the power transmitting flange 31.

The power transmitting flange 31 transmits the rotation power from the drive gear 30 to the electrophotographic photosensitive member 2. The power transmitting flange 31 is fitted into the inside low portion 24 of the cylindrical body 20.

The bearing flange 32 rotatably supports the electrophotographic photosensitive member 2. The bearing flange 32 is fitted into the inside low portion 25 of the cylindrical body 20.

The electrification mechanism 41 shown in FIGS. 1 and 2 is of a non-contact type utilizing corona discharge. The electrification mechanism 41 includes a discharging electrode 41A, shielding electrode 41B, and a grid electrode 41C. The discharging electrode 41A made of a wire is positioned substantially parallel with the axial direction of the electrophotographic photosensitive member 2, and is separated from the surface of the photosensitive layer 21 by not less than 0.1 mm and not more than 1.0 mm, for example. The grid electrode 41C made of a plurality of wires is positioned substantially parallel with the axial direction of the electrophotographic photosensitive member 2 in a non-contact manner. In the grid electrode 41C, each of the adjacent wires provides a discharge opening 41D.

In such electrification mechanism 41, high voltage is applied to the discharging electrode 41A and the shielding electrode 41B to generate corona discharge, so that a corona shower is applied to the photosensitive layer 21 through the discharge opening 41D, thereby charging the photosensitive layer 21.

Figure 8:
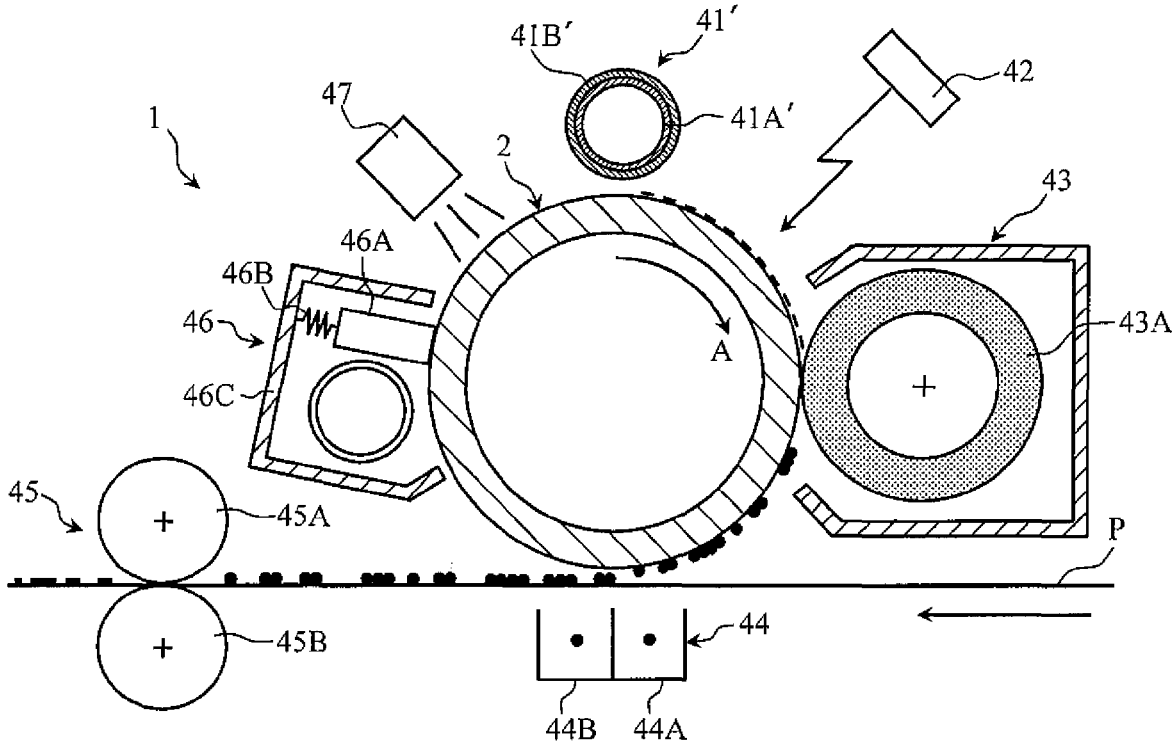
FIG. 8 is a schematic view corresponding to FIG. 1, illustrating another example of the image forming apparatus according to the present invention.
Figure 9:
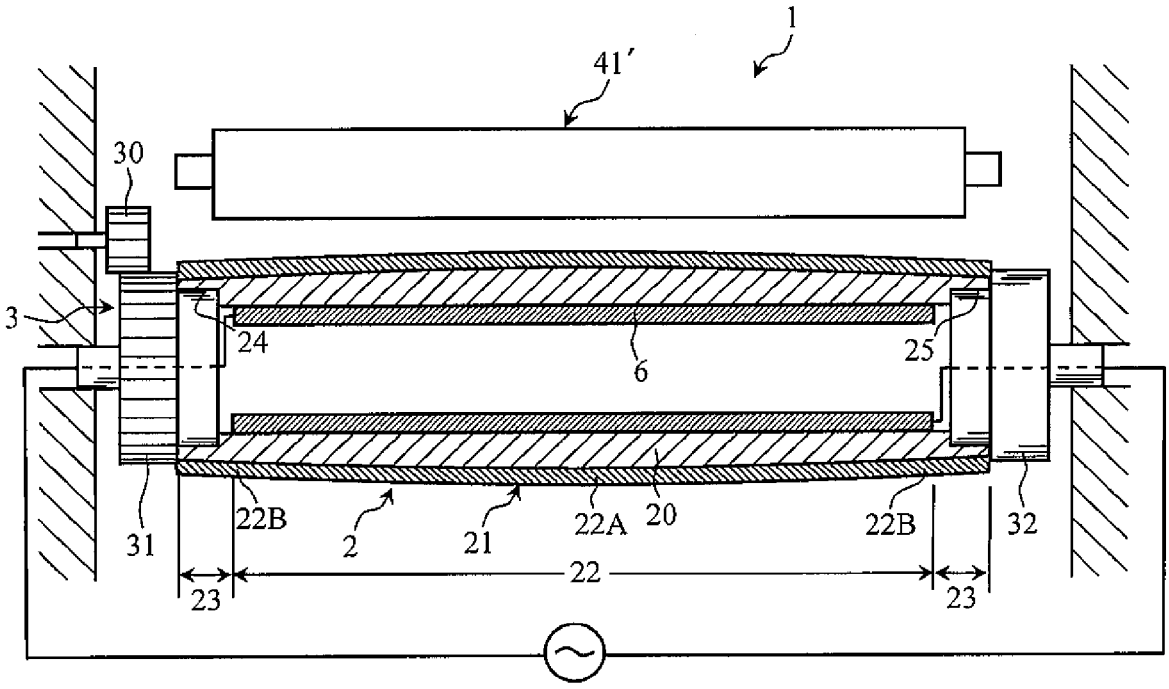
FIG. 9 is a sectional view corresponding to FIG. 2, illustrating the principal portions of the image forming apparatus shown in FIG. 8.

As the electrification mechanism, a non-contact electrification roller 41' shown in FIGS. 8 and 9 may be used. The electrification roller 41' is positioned close to the surface of the electrophotographic photosensitive member 2 with a gap not less than 5 μm and not more than 350 μm. By applying a direct-current voltage or a vibration voltage of superimposed direct-current voltage and alternating-current voltage to the electrification roller 41', the photoconductive layer 21 is charged. The electrification roller 41 includes conductive member 41A' which is a hollow or solid cylinder and a resistor layer 41B' covering the conductive member 41A', and is positioned substantially parallel with the axial direction of the electrophotographic photosensitive member 2.

The conductive member 41A' is made of iron, stainless, steel, or aluminum alloy. The resistor layer 41B' is made to have a volume resistivity value of not less than $10^5$ Ω·cm and not more than $10^{12}$ Ω·cm. Such resistor layer 41B' is formed into a resin roller by performing injection molding method, using a mixture of a resin material and a conductive material, for example. The resin material may include EEA resin (ethylene ethyl acrylate), POM resin (polyacetal), PA resin (nylon, polyamid), PBT resin (polybutylene terephthalate), and PPS resin (polyphenylene sulfide), for example. The conductive material may include a magnetic body of ferrite system, alnico system, or neodymium system. The resistor layer 41B' may also be made of urethane rubber or silicon rubber, by adding a conductive particle such as carbon black, and if necessary, adding sulfating agent or foaming agent and performing heat foaming.

When using the non-contact electrification mechanism 41 shown in FIGS. 1 and 2 and the non-contact electrification roller 41' shown in FIGS. 8 and 9, the electrification mechanisms 41, 41' do not contact the electrophotographic photosensitive member 2, and thus lifetime of the electrophotographic photosensitive member 2 and the electrification mechanism 41, 41' is advantageously prolonged. In using the non-contact electrification mechanisms 41, 41', as a distance from the photosensitive layer 21 is set to be shorter, the electrification potential at the photosensitive layer 21 becomes higher, whereas as the distance is set to be longer, the electrification potential becomes lower. As the electrophotographic photosensitive member 2 has an outer diameter larger at the middle portion 22A of the latent image forming area 22 than at the end portions 22B of the latent image forming area 22 in the axial direction, the distance from the electrification mechanism 41, 41' is shorter at the middle portion 22A of the latent image forming area 22 than at the end portions 22B of the latent image forming area 22.

The distance between the electrification mechanism 41, 41' and the electrophotographic photosensitive member 2 (i.e. length of a perpendicular line extending from a point on the surface (latent image forming area 22) of the electrophotographic photosensitive member 2 to the electrification mechanism 41, 41'), though depending on the type of the electrophotographic photosensitive member 2 (cylindrical body 20), becomes shorter gradually or stepwise as proceeding from the end portions 22B to the middle portion 22A of the latent image forming area 22, for example. A ratio of the distance at the end portions 22B of the latent image forming area 22 to the distance at the middle portion 22A of the latent image forming area 22 is set to be not less than 1.1 and not more than 2.5 to 1, for example. Further, the distance at the end portions 22B of the latent image forming area 22 is set to be not less than 7 μm and not more than 350 μm, for example, while the distance at the middle portion 22A of the latent image forming area 22 is set to be not less than 5 μm and not more than 300 μm.

The electrification mechanisms 41, 41' are positioned to satisfy the following Formula 1, for example.

$$0.6\ [\mu m/^\circ C.] \leqq D\ [\mu m]/T[^\circ C.] \leqq 10.0\ [\mu m/^\circ C.]$$

In the Formula 1, T indicates a difference between temperature of the electrophotographic photosensitive member 2 at a first reference point on the latent image forming area 22 and temperature of the electrophotographic photosensitive member 2 at a second reference point on the latent image forming area 22, and D indicates a difference between length of a first perpendicular line extending from the first reference point to the electrification mechanism 41, 41' and length of a second perpendicular line extending from the second reference point to the electrification mechanism 41, 41'.

In the image forming apparatus 1 according to the present invention, the length of the perpendicular line extending from the reference point on the latent image forming area 22 to the electrification mechanism 41, 41' may be adjusted according to temperature at the reference point. In such image forming apparatus 1, even if heating by the heater 6 generates heat distribution at the latent image forming area of the photosensitive layer, as the distance between the latent image forming area 22 and the electrification mechanism 41, 41' is adjusted according to the heat distribution, variation in charging characteristic of the electrophotographic photosensitive member 2 due to the heat distribution can be reduced.

The exposure mechanism 42 shown in FIG. 1 serves to form an electrostatic latent image on the electrophotographic photosensitive member 2, and is capable of emitting light of a predetermined wavelength (not less than 650 nm and not more than 780 nm, for example). The exposure mechanism 42 forms an electrostatic latent image which is an electric potential contrast by emitting light on the surface of the electrophotographic photosensitive member 2 according to an image signal, and lowering the electrical potential at the emitted portion. An example of the exposure mechanism 42 includes a LED head in which LED elements capable of emitting light at a wavelength of e.g. about 680 nm are arranged at 600 dpi.

Of course, the exposure mechanism 42 may be capable of emitting laser light. By replacing the exposure mechanism 42 having LED head with an optical system using e.g. laser light or a polygon mirror or with an optical system using e.g. a lens or a mirror through which light reflected at paper is transmitted, the image forming apparatus may have a function of a copying apparatus.

The development mechanism 43 forms a toner image by developing the electrostatic latent image formed on the electrophotographic photosensitive member 2. The development mechanism 43 includes a magnetic roller 43A for magnetically holding developer (toner), and a wheel (not shown) or a so-called skid for keeping a substantially constant distance (gap) from the electrophotographic photosensitive member 2.

The developer serves to develop a toner image formed on the surface of the electrophotographic photosensitive member 2, and is frictionally charged at the development mechanism 43. The developer may be a binary developer of magnetic carrier and insulating toner, or a one-component developer of magnetic toner.

The magnetic roller 43A serves to transfer the developer to the surface (developing area) of the electrophotographic photosensitive member 2.

In the development mechanism 43, the toner frictionally charged by the magnetic roller 43A is transferred in a form of magnetic brush with bristles each having a predetermined length. On the developing area of the electrophotographic photosensitive member 2, the toner is caused to stick to the surface of the photosensitive member by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 43 utilizes dry developing method, wet developing method using liquid developer may be utilized.

The transfer mechanism 44 transfers the toner image of the electrophotographic photosensitive member 2 on a recording medium P supplied to a transfer area between the electrophotographic photosensitive member 2 and the transfer mechanism 44. The transfer mechanism 44 includes a transfer charger 44A and a separation charger 44B. In the transfer mechanism 44, the rear side (non-recording surface) of the recording medium P is charged in the reverse polarity of the toner image by the transfer charger 44A, and by the electrostatic attraction between this electrification charge and the toner image, the toner image is transferred on the recording medium P. Further, in the transfer mechanism 44, simultaneously with the transfer of the toner image, the rear side of the recording medium P is charged in alternating polarity by the separation charger 44B, so that the recording medium P is quickly separated from the surface of the electrophotographic photosensitive member 2.

As the transfer mechanism 44, a transfer roller driven with the rotation of the electrophotographic photosensitive member 2, and being spaced from the electrophotographic photosensitive member 2 by a minute gap (generally, not more than 0.5 mm) may be used. Such transfer roller applies a transfer voltage to the recording medium P, using e.g. direct-current power source, for attracting the toner image of the electrophotographic photosensitive member 2 onto the recording medium. In using the transfer roller, a separation member such as the separation charger 44B is omitted.

The fixing mechanism 45 serves to fix a toner image, which is transferred on the recording medium P, onto the recording medium P, and includes a pair of fixing rollers 45A, 45B. Each of the fixing rollers 45A, 45B is, for example, a metal roller coated by Teflon (registered trademark). In the fixing mechanism 45, the recording medium P passes through between the fixing rollers 45A, 45B, so that the toner image is fixed on the recording medium P by heat or pressure.

The cleaning mechanism 46 shown in FIGS. 1 and 2 serves to remove the toner remaining on the surface of the electrophotographic photosensitive member 2, and includes a cleaning blade 46A.

The cleaning blade 46A serves to scrape the remaining toner off the surface of the surface layer 29 of the electrophotographic photosensitive member 2. The cleaning blade 46A is supported by a case 46C via urging means such as springs 46B, so that its tip end presses the latent image forming area 22 of the electrophotographic photosensitive member 2. The cleaning blade 46A is made of a rubber material mainly containing polyurethane resin, for example, and has a thickness of not less than 1.0 mm and not more than 1.2 mm at its tip portion in contact with the surface layer 29 (see FIG. 2), a linear pressure of 14 gf/cm (generally not less than 5 gf/cm and not more than 30 gf/cm), and a JIS hardness of 74 degrees (preferably not less than 67 degrees and not more than 84 degrees).

The discharging mechanism 47 removes surface charge on the electrophotographic photosensitive member 2. The discharging mechanism 47 irradiates the whole surface (the surface layer 29) of the electrophotographic photosensitive member 2 by a light source such as LED, and removes the surface charge (remaining electrostatic latent image) of the electrophotographic photosensitive member 2.

Next, the function of the image forming apparatus 1 is described below.

In forming images by the image forming apparatus 1, the rotation mechanism 3 rotates the electrophotographic photosensitive member 2, while the heater 6 heats the electrophotographic photosensitive member 2 (photosensitive layer 21). Meanwhile, the surface of the electrophotographic photosensitive member 2 (photosensitive layer 21) is charged by the electrification mechanism 41, 41'.

As the electrophotographic photosensitive member 2 has an outer diameter larger at the middle portion 22A of the latent image forming area 22 than at the end portions 22B of the latent image forming area 22 in the axial direction, the distance from the electrification mechanism 41, 41' is shorter at the middle portion 22A of the latent image forming area 22 than at the end portions 22B of the latent image forming area 22. When heating the electrophotographic photosensitive member 2 (photosensitive layer 21) by the heater, the heat escapes from the power transmission flange 31 and the bearing flange 32 connected to the electrophotographic photosensitive member 2, while accumulating at the middle portion 22A. Thus, temperature of the electrophotographic photosensitive member 2 is likely to be higher at the middle portion 22A of the latent image forming area 22 than at the end portions 22B of the latent image forming area 22. As the photosensitive layer 21 of the electrophotographic photosensitive member 2 has temperature dependency, the charging characteristic is lowered at a portion with high temperature. The middle portion 22A of the electrophotographic photosensitive member 2 according to the present invention has high temperature and thus has low charging characteristic, while being positioned close to the electrification mechanism 41, 41'. On the other hand, the end portions of the latent image forming area 22 have low temperature and thus have high charging characteristic, while being positioned apart from the electrification mechanism 41, 41'. As a result, in the electrophotographic photosensitive member 2, by adjusting the distance from the electrification mechanism 41, 41' in the axial direction of the electrophotographic photosensitive member 2, variation in charging characteristic due to variation in temperature in the axial direction of the electrophotographic photosensitive member 2 can be prevented. Further, by setting the difference between the outer diameters at the end portions 22B of the latent image forming area 22 and at the middle portion 22A of the latent image forming area 22 to not less than 5 μm and not more than 150 μm, the difference between the charging characteristics at the middle portion 22A and at the end portions 22B can be maintained within a proper range, so that variation in charging characteristic due to variation in temperature in the axial direction of the electrophotographic photosensitive member 2 can be properly prevented.

In the electrophotographic photosensitive member 2, the outer diameter of the cylindrical body 20 becomes larger gradually or stepwise as proceeding from the end portions 22B to the middle portion 22A of the latent image forming area 22. Thus, the charging characteristic of the electrophotographic photosensitive member 2 can be gradually changed in the axial direction (corresponding to heat distribution due to heat from the heater 6). Therefore, in the electrophotographic photosensitive member 2, variation in charging characteristic in the axial direction can be properly prevented.

Especially, by setting a ratio of the distance from the electrification mechanism 41, 41' at the end portions 22B of the latent image forming area 22 to the distance at the middle portion 22A of the latent image forming area 22 to not less than 1.1 and not more than 2.5 to 1, or by setting the distance at the end portions 22B of the latent image forming area 22 to be not less than 7 μm and not more than 350 μm and the distance at the middle portion 22A of the latent image forming area 22 to be not less than 5 μm and not more than 300 μm, variation in charging characteristic due to variation in temperature in the axial direction of the electrophotographic photosensitive member 2 can be properly prevented.

Further, by positioning the electrification mechanism 41, 41' so that the difference T in temperature of the electrophotographic photosensitive member 2 at the first and second reference points on the latent image forming area 22 and the difference D in length of the perpendicular lines extending from the first and second reference points to the electrification mechanism 41, 41' satisfy the Formula 1, variation in charging characteristic due to variation in temperature in the axial direction of the electrophotographic photosensitive member 2 can be properly prevented.

As described above, the exposure mechanism 42 exposes the electrophotographic photosensitive member 2 to form electrostatic latent image on the electrophotographic photosensitive member 2 as an electric potential contrast. The electrostatic latent image is developed by the development mechanism 43. Specifically, toner is caused to stick to the surface of the electrophotographic photosensitive member 2 by electrostatic attraction between the toner and the electrostatic latent image which is caused to be visible.

More specifically, the rear side of a recording medium P such as paper is charged in the reverse polarity of the toner image by the transfer charger 44, whereby the toner image on the surface of the electrophotographic photosensitive member 2 is transferred on the recording medium P. The toner image transferred on the recording medium P is fixed on the recording medium P by heat or pressure by the fixing mechanism 45.

In the image forming apparatus 1, the toner remaining on the surface of the electrophotographic photosensitive member 2 is mechanically removed by the cleaning mechanism 46, and remaining electrostatic latent image is removed by emitting intense light onto the entire surface of the electrophotographic photosensitive member 2 by the discharging mechanism 47.

As described above, in the image forming apparatus, variation in charging characteristic in the axial direction of the electrophotographic photosensitive member 2 is prevented. Thus, on the electrophotographic photosensitive member 2, electrostatic latent images can be properly formed, and thus toner images can be properly formed. As a result, the toner images transferred and fixed on the recording medium P are prevented from variation in image density.

In this way, in the image forming apparatus 1, variation in charging characteristic in the axial direction of the electrophotographic photosensitive member 2 can be prevented and thus variation in image density can be prevented. Such effect can also be properly obtained when the electrification mechanism 41 is of non-contact type and includes a conductive member which is a hollow or solid cylinder and a resistor layer covering the conductive member, and the resistor layer is made to have a volume resistivity value of not less than $10^4$ Ω·cm and not more than $10^{12}$ Ω·cm. Further, the above-described effect can also be properly obtained when the photosensitive layer of the electrophotographic photosensitive member 2 includes a photoconductive layer 28 made of an inorganic material, and a surface layer 29 made of an inorganic material and laminated on the photoconductive layer 28.

The present invention is not limited to the above-described embodiments, but may be variously modified. For example, the distance between the electrophotographic photosensitive member and the electrification mechanism may be set by modifying the structure of the electrification mechanism, so that the distance is shorter at the middle portion than at the end portions of the latent image forming area. Specifically, the distance can be changed, for example, by bending the grid wires, setting the outer diameter of the electrification roller to be larger at the middle portion than at the end portions in the axial direction, or positioning the electrification mechanism to be inclined relative to the axial direction.

Further, the heating means for heating the electrophotographic photosensitive member is not limited to the heater accommodated within the electrophotographic photosensitive member. Alternatively, a heating means provided outside of the electrophotographic photosensitive member, or heat generated from a component incorporated in the image forming apparatus other than the electrophotographic photosensitive member may be used.

EXAMPLE 1

In the present example, it was studied how changes in outer diameter of the cylindrical body of the electrophotographic photosensitive member affects variation in image when using a non-contact corona electrification mechanism.

(Manufacture of Electrophotographic Photosensitive Member)

The cylindrical body was made of a 3003-O aluminum alloy drawn tube with outer diameter of ϕ84.5 mm, inner diameter of ϕ80 mm, and length of 362 mm. Specifically, in manufacture of the cylindrical body, a lathe (SR400 manufactured by Eguro Ltd.) was used for roughly cutting the end surfaces, the inner surface, and the outer surface of the drawn tube, and as a finish process, using a NC lathe (RL700 manufactured by Eguro Ltd.), mirror grinding was performed to the outer surface of the drawn tube by a diamond cutting tool. In the finish process, numerical control was performed to change the outer diameter in the axial direction of the cylindrical body, so that a plurality of cylindrical bodies having different outer diameters was manufactured.

The cylindrical body made in this way was cleaned and then incorporated in the reactor of the CVD apparatus shown in FIG. 7, in which a photosensitive layer was formed with a thickness of 31 μm under film forming conditions shown in the following Table 1.

In the CVD apparatus shown in FIG. 7, for forming the photosensitive layer to have a constant thickness in the axial direction, the length of the positioning rings 50A, 50B was adjusted to position the cylindrical body 20 within a stabilized discharge area. In order to form the photosensitive layer to have a constant thickness also in the circumferential direction, the cylindrical body 1 was rotated together with the body holder 51 by the motor 52 at a rotation velocity of 1 rpm.

TABLE 1

| | | |
|---|---|---|
| | Anti-charge Injection Layer | |
| Conditions for Forming Photosensitive Layer (amount of each gas is the absolute amount to be introduced in CVD apparatus) | Temperature of Body [° C.] | 260 |
| | Gas Pressure [Pa] | 60 |
| | 13.56 Hz RF Electric Power [W] | 120 |
| | Film Forming Time [min] | 80 |
| | $SiH_4$ Gas Flow Amount [sccm] | 75 |
| | $B_2H_6$ Gas Flow Amount [sccm] | 0.1 |
| | NO Gas Flow Amount [sccm] | 10 |
| | Film Thickness [μm] | 4 |
| | Photoconductive Layer | |
| | Temperature of Body [° C.] | 260 |
| | Gas Pressure [Pa] | 75 |
| | 13.56 Hz RF Electric Power [W] | 125 |
| | Film Forming Time [min] | 380 |
| | $SiH_4$ Gas Flow Amount [sccm] | 100 |
| | $B_2H_6$ Gas Flow Amount [sccm] | 0.0002 |
| | $H_2$ Gas Flow Amount [sccm] | 125 |
| | Film Thickness [μm] | 26 |
| | Surface Layer | |
| | Temperature of Body [° C.] | 260 |
| | Gas Pressure [Pa] | 70 |
| | 13.56 Hz RF Electric Power [W] | 155 |
| | Film Forming Time [min] | 80 |
| | $SiH_4$ Gas Flow Amount [sccm] | 40 |
| | $CH_4$ Gas Flow Amount [sccm] | 230 |
| | He Gas Flow Amount [sccm] | 295 |
| | Film Thickness [μm] | 1 |

Next, a heater was accommodated within the cylindrical body. The heater included a pair of insulating sheets sandwiching a resistor therebetween. One of the insulating sheets contacting the inner surface of the cylindrical body was a PET film with a thickness of 1 mm, while the other insulating sheet was a PET film with a thickness of 3 mm. The resistor was made of a nichrome wire with a diameter of 0.8 mm, by covering silicon rubber thereon and arranging in a wavy line. Note that the resistor was formed uniformly, differently from the heater 6 as shown in FIGS. 5 and 6, in which the resistor is formed in an arrangement thinner at the middle portion than at the end portions.

(Measurement of Outer Diameter of Cylindrical Body)

The outer diameter of the cylindrical body was measured at any 10 points in the circumferential direction of the cylindrical body, and the measurement values at the ten points were averaged. For measurement, a non-contact laser outer-diameter measuring device (DV-305-LSM506/6000 manufactured by Mitutoyo Corporation) was used. Measurements were performed at the middle portion of the latent image forming area spaced from one end surface of the body by 180 mm in the axial direction, at one of the end portions of the latent image forming area spaced from the end surface of the body by 20 mm in the axial direction (end portion 1), and at the other end portions of the latent image forming area spaced from the end surface of the body by 330 mm in the axial direction (end portion 2). Measurement results of the outer diameters are shown in the following Table 2.

(Evaluation of Variation in Image)

The electrophotographic photosensitive member was incorporated in an image forming apparatus (KM-8030 (remodeled) manufactured by Kyocera Mita Corporation). Under conditions repeatedly changed from room temperature of 5° C. and humidity of 15% RH to room temperature of 40° C. and humidity of 85% RH, variation in image density of halftone image was visually checked for evaluation. Temperature of the electrophotographic photosensitive member was controlled by the heater to be about 45° C. The image forming apparatus worked under process conditions as described below.

Process Conditions of Image Forming Apparatus (at the middle portion of the latent image forming area)

Circumferential Velocity of Photosensitive Member: 440 mm/sec

Charging Voltage: 330V

Surface Temperature of Photosensitive Member: 45° C.

Type of Electrification Mechanism: Corona Electrification Mechanism

Width of Grid Opening: 32 mm

Intervals of Grid Wires: 1.2 mm

Type of Exposure Mechanism: Laser Unit

Wavelength: 680 nm

Light Exposure: 0.5 μJ/cm$^2$

Type of Discharging Mechanism: LED Unit

Wavelength: 660 nm

Light Exposure: 6.0 μJ/cm$^2$

The evaluation results of images were placed in four grades A, B, C, and D. A, B, and C indicate the image qualities without no practical problem. The evaluation results are shown in the following Table 2 together with the measurement results of the outer diameters of the cylindrical bodies.

TABLE 2

| | Outer Diameter of Body [mm] | | | |
|---|---|---|---|---|
| | Middle Portion of | End Portions of Latent Image Forming Area | | |
| Sample No. | Latent Image Forming Area | End Portion 1 | End Portion 2 | Evaluation Result of Image |
| No. 1 | ϕ84.040 | ϕ84.040 | ϕ84.041 | D |
| No. 2 | ϕ84.041 | ϕ84.036 | ϕ84.034 | B |
| No. 3 | ϕ84.041 | ϕ84.020 | ϕ84.022 | A |
| No. 4 | ϕ84.040 | ϕ84.012 | ϕ84.010 | A |
| No. 5 | ϕ84.042 | ϕ83.994 | ϕ83.990 | B |
| No. 6 | ϕ84.041 | ϕ83.940 | ϕ83.945 | C |
| No. 7 | ϕ84.040 | ϕ83.892 | ϕ83.890 | C |

As can be seen from Table 2, among the evaluation results of samples, No. 1 shows a result at a conventional electrophotographic photosensitive member out of the scope of the present invention, in which variation in image density was generated according to change of use environment.

Samples No. 2 to 7 are electrophotographic photosensitive members according to the present invention, each having an outer diameter larger at the middle portion of the latent image forming area of the body than at the end portions of the latent image forming area. In the samples No. 2 to 5, images of good quality were constantly obtained regardless of change of use environment. In the samples No. 6 and 7, images without practical problem were obtained.

The results also shows that it is preferable that the difference between the outer diameters at the middle portion and at the end portions of the latent image forming area of the electrophotographic photosensitive member may be not less than 5 μm and not more than 150 μm, and more preferably, not less than 5 μm and not more than 50 μm.

When the difference between the outer diameters at the middle portion and at the end portions of the latent image forming area was more than 150 μm, a defect infinishing process of the body such as unevenness and scratches were likely to be generated in the circumferential direction of the body, which damaged the quality of the body surface.

EXAMPLE 2

In the present example, it was studied how changes in a distance between the electrophotographic photosensitive member and the electrification mechanism affects variation in image when using a non-contact corona electrification mechanism.

In the present example, manufacture of the electrophotographic photosensitive member and the evaluation of variation in image were performed the same as the Example 1. However, a ratio of the distance between the electrification mechanism and the surface of the electrophotographic photosensitive member at the middle portion of the latent image forming area, to the distance at the end portions of the latent image forming area, in the axial direction of the electrophotographic photosensitive member, was changed within the range of conditions described below. The distance was adjusted by bending the grid wires or by positioning the electrification mechanism to be inclined relative to the axial direction.

Conditions of Distance

Distance between a portion on the electrophotographic photosensitive member apart from one end surface by 20 mm and the electrification mechanism≧Distance between a portion on the electrophotographic photosensitive member apart from one end surface by 180 mm and the electrification mechanism Distance between a portion on the electrophotographic photosensitive member apart from one end surface by 18 mm and the electrification mechanism: 0.4±0.1 mm The distance was measured at the middle portion of the latent image forming area spaced from one end surface of the body by 180 mm in the axial direction, and at one of the end portions of the latent image forming area spaced from the end surface of the body by 20 mm in the axial direction. Here, the distance is defined as the minimal distance between the measurement point on the surface of the electrophotographic photosensitive member and the wire of the corona electrification mechanism. Each measurement result of the distance is indicated as a ratio of the distance between a portion spaced from one end surface by 20 mm in the axial direction and the electrification mechanism to the distance between a portion spaced from the end surface by 180 mm in the axial direction and the electrification mechanism (1.0, 1.1, 1.5, 2.0, and 2.5 to 1, respectively).

TABLE 3

| Ratio of Distance at End Portion to Distance at Middle Portion | Evaluation Result of Image |
|---|---|
| 1.0 | D |
| 1.1 | A |
| 1.5 | A |
| 2.0 | B |
| 2.5 | C |

As shown in Table 3, the sample with the ratio of 1.0 is a conventional image forming apparatus out of the scope of the present invention, in which variation in image density was generated according to change of use environment.

On the other hand, in image forming apparatuses with the ratio of not less than 1.1 and not more than 2.5, images of good quality were obtained. Especially in the image forming apparatuses with the ratio of not less than 1.1 and not more than 2.0, images of high quality were obtained, and the most preferable was the forming apparatuses with ratio of not less than 1.1 and not more than 1.5. However, in the image forming apparatus with a ratio of more than 2.5, variation in image density was generated in use environment with temperature of 40° C. and humidity of 85% RH.

EXAMPLE 3

In the present example, it was studied how changes in a distance between the electrophotographic photosensitive member and the electrification mechanism affects variation in image when using a non-contact electrification roller positioned close to the photosensitive member.

In the present example, the evaluation of variation in image was performed basically the same as the examples 1 and 2, but the corona electrification mechanism was replaced with a closely-positioned electrification roller.

The closely-positioned electrification roller was made of a round stainless steel based material, and is provided with a resistor layer having volume resistivity value of $5\times10^6$ Ω·cm. The resistor layer was made by dispersing a conductive powder which is a mixture of nylon 6 and ferrite magnetic material containing Mn—An—Fr and Ni—Zn—Fr.

The distance was adjusted by changing the form of the outer surface of the resistor layer of the electrification roller or by positioning the electrification roller to be inclined relative to the axial direction. When changing the form of the outer surface of the resistor layer of the electrification roller, the outer surface was tapered or indented using a diamond cutting tool of a lathe.

The distance between the surface of the electrophotographic photosensitive member and the electrification roller was measured at the end portions of the latent image forming area spaced from one end surface of the body by 50 mm and by 310 mm in the axial direction, and at the middle portion of the latent image forming area spaced from the end surface of the body by 180 mm in the axal direction. The distance is defined as the minimal distance between the measurement point on the surface of the electrophotographic photosensitive member and the surface the electrification roller. The measurement results of the distances are shown in the following Table 4.

TABLE 4

| | Distance from Surface of Electrophotographic Photosensitive Member to Surface of Electrification Roller [μm] | | | |
|---|---|---|---|---|
| | | End Portions of Latent Image Forming Area | | |
| Sample No. | Middle Portion of Latent Image Forming Area | Spaced from End Surface by 50 mm | Spaced from End Surface by 310 mm | Evaluation Result of Image |
| No. 8 | 4 | 4 | 4 | D |
| No. 9 | 5 | 7 | 8 | A |
| No. 10 | 50 | 60 | 55 | A |
| No. 11 | 100 | 160 | 170 | A |
| No. 12 | 200 | 280 | 250 | A |
| No. 13 | 300 | 350 | 345 | B |
| No. 14 | 400 | 400 | 380 | D |

As can be seen from Table 4, in the image forming apparatuses No. 9 to 13, the evaluation results show no variation in image density. Especially in the image forming apparatuses No. 9 to 12, images of high quality were obtained.

On the other hand, in the sample No. 8 as a conventional image forming apparatus, variation in density was found in halftone images, or the electrification roller contacts the surface of the electrophotographic photosensitive member so that streaks were found on the surface of the electrophotographic photosensitive member.

In the sample No. 14 which is also a conventional image forming apparatus, variation in image density was generated and image density was likely to be lowered due to improper charging of the electrophotographic photosensitive member.

As a result, it can be seen from Table 4 that, in the image forming apparatus provided with a heater accommodated within the cylindrical body of the electrophotographic photosensitive member, it is preferable that the distance between the electrification mechanism and the surface of the electrophotographic photosensitive member is set to not less than 7 μm and not more than 350 μm at the end portions of the latent image forming area, and the distance between the electrification mechanism and the surface of the electrophotographic photosensitive member is set to not less than 5 μm and not more than 300 μm at the middle portion of the electrostatic latent image forming area. More preferably, the distance at the end portions of the latent image forming area may be, set to not less than 7 μm and not more than 280 μm, and the distance at the middle portion of the latent image forming area may be set to not less than 5 μm and not more than 200 μm.

EXAMPLE 4

In the present example, a study was made on a relationship between a difference in temperature at the electrophotographic photosensitive member and a difference in distance between the surface of the electrophotographic photosensitive member and the electrification mechanism of the image forming apparatus.

In the present example, manufacture of the electrophotographic photosensitive member and evaluation of variation in image were performed basically the same as the example 1.

The distance between the surface of the electrophotographic photosensitive member and the electrification mechanism was measured at predetermined first and second points on the electrophotographic photosensitive member. The first and second points were determined so that each difference D, which is a difference between the distances (lengths of perpendicular lines) from the first and second points to the electrification mechanism, is set as shown in the following Table 5. Temperature was measured at the first and second points simultaneously. The difference in distance D and a difference in temperature T at the first and second points are shown in the following Table 5.

TABLE 5

| | Evaluation | Difference between Measurement Values at First and Second Reference Points | |
|---|---|---|---|
| Sample No. | Result of Image | Temperature Difference T [° C.] | Distance Difference D [μm] |
| 15 | A | 1 | 10 |
| 16 | A | 4 | 30 |
| 17 | A | 5 | 3 |
| 18 | A | 7 | 20 |
| 19 | D | 3 | 1 |

As can be seen from Table 5, in the samples No. 15 to 18, images of good quality were obtained without variation in halftone images. On the other hand, in the sample No. 19, variation in density was generated. From the results shown in Table 5, relationship between the difference in distance D and the difference in temperature T at the first and second points can be expressed by the following formula as conditions for preventing variation in density.

$$0.6\ [\mu m/^\circ C.] \leqq D\ [\mu m]/T[^\circ C.] \leqq 10.0\ [\mu m/^\circ C.] \quad \text{Formula 1}$$

The invention claimed is:

1. An image forming apparatus comprising:

an electrophotographic photosensitive member including a substantially cylindrical body having outer circumference on which a photosensitive layer having a latent image forming area is formed; and a non-contact electrification unit positioned substantially parallel to axial direction of the body;

wherein a distance between a surface of the electrophotographic photosensitive member and the electrification unit is shorter at a middle portion of the latent image forming area than at end portions of the latent image forming area;

the image forming apparatus satisfying the following Formula 1;

$$0.6\ \mu m/^\circ C. \leqq D/T \leqq 10.0\ \mu m/^\circ C.; \qquad \text{Formula 1}$$

wherein in the Formula 1, T is a difference between a temperature of the electrophotographic photosensitive member at a first reference point on the latent image forming area and a temperature of the electrophotographic photosensitive member at a second reference point on the latent image forming area, and D is a difference between a length of a first perpendicular line extending from the first reference point to the electrification unit and a length of a second perpendicular line extending from the second reference point to the electrification unit.

2. The image forming apparatus according to claim 1, wherein the distance gradually becomes shorter as proceeding from the end portions to the middle portion of the latent image forming area.

3. The image forming apparatus according to claim 1, wherein the distance becomes shorter stepwise as proceeding from the end portions to the middle portion of the latent image forming area.

4. The image forming apparatus according to claim 1, wherein a ratio of the distance at the end portions of the latent image forming area to the distance at the middle portion of the latent image forming area is not less than 1.1 and not more than 2.5 to 1.

5. The image forming apparatus according to claim 1, wherein the distance is not less than 7 μm and not more than 350 μm at the end portions, while being not less than 5 μm and not more than 300 μm at the middle portion.

6. The image forming apparatus according to claim 1, wherein the electrophotographic photosensitive member further comprises a heating member for heating the latent image forming area of the photosensitive layer.

7. The image forming apparatus according to claim 1, wherein during operation, temperature of the latent image forming area is higher at the middle portion than at the end portions of the latent image forming area.

8. The image forming apparatus according to claim 1, wherein the electrification unit comprises a conductive member which is a hollow or solid cylinder and a resistor layer covering a surface of the conductive member, the resistor layer having a volume resistivity value of not less than $10^4$ Ω·cm and not more than $10^{12}$ Ω·cm.

9. The image forming apparatus according to claim 1, wherein the photosensitive layer comprises a photoconductive layer made of inorganic material and a surface layer made of inorganic material and laminated on the photoconductive layer.

* * * * *